US008751072B1

(12) United States Patent
Goldman et al.

(10) Patent No.: US 8,751,072 B1
(45) Date of Patent: Jun. 10, 2014

(54) METHOD OF REMOVING SUSPECTED SECTION OF TRACK

(71) Applicant: Thales Canada, Inc., Toronto (CA)

(72) Inventors: Andrea Goldman, Toronto (CA); Duka Krunic, Oakville (CA); Roman Rudzinski, Whitby (CA)

(73) Assignee: Thales Canada, Inc., Toronto, Ontario (CA)

( * ) Notice: Subject to any disclaimer, the term of this patent is extended or adjusted under 35 U.S.C. 154(b) by 0 days.

(21) Appl. No.: 13/727,095

(22) Filed: Dec. 26, 2012

(51) Int. Cl.
*G06F 7/00* (2006.01)

(52) U.S. Cl.
USPC ..... 701/19; 701/20

(58) Field of Classification Search
USPC ..... 701/19–20; 246/2 R, 20, 111; 104/2
See application file for complete search history.

(56) References Cited

U.S. PATENT DOCUMENTS

| | | | | |
|---|---|---|---|---|
| 3,786,512 | A * | 1/1974 | McCue et al. | 346/33 D |
| 6,694,231 | B1 | 2/2004 | Rezk | |
| 6,848,657 | B2 | 2/2005 | Young et al. | |
| 7,974,246 | B1 * | 7/2011 | Fulthorp et al. | 370/337 |
| 8,311,730 | B2 | 11/2012 | Neff | |
| 2008/0195257 | A1 | 8/2008 | Rauch et al. | |
| 2008/0195265 | A1 * | 8/2008 | Searle et al. | 701/19 |
| 2009/0184210 | A1 | 7/2009 | Groves et al. | |
| 2011/0238241 | A1 | 9/2011 | Brady et al. | |

FOREIGN PATENT DOCUMENTS

WO 2011153114 12/2011

OTHER PUBLICATIONS

US Department of Transportation, "Communications-Based Train Control (CBTC) Before/After Cost Effectiveness Study," Dec. 31, 2011, <http://www.fta.dot.gov/documents/CBTC_before-after_cost_effectiveness_study_-_Report_FTA-TX-26-7005_2010_01_-_101025_final_draft1_%283%29.pdf>.

Docklands, "The Fixed-Block System," 2012, <http://dodger.home.xs4all.nl/tech.htm>.

Lockheed Martin Corporation, "Rail Systems Improving Efficiency and Safety in the Rail Industry," 2008, <http://www.google.com/url?sa=t&rct=j&q=&esrc=s&source=web&cd=3&ved=0CD0QFjAC&url=http%3A%2F%2Fwww.packagingdigest.com%2Ffile%2F2152-Lockheed_Martin_PTC.pdf%3Fforce%3Dtrue&ei=CaamUM7Hl4nQygH9qoGQAg&usg=AFQjCNFAHMJhrh0_dKQ9YO2e4yy1-SyaOA&sig2=YNV5zXwMn_jFJpG7bvPmgQ>.

Modurban, 2009, <http://www.transport-research.info/Upload/Documents/201210/20121031_134819_62750_D85_Summary;_MODURBAN_architecture,_description_of_alternatives,_for_publication..pdf>.

* cited by examiner

*Primary Examiner* — Yonel Beaulieu
(74) *Attorney, Agent, or Firm* — Lowe Hauptman & Ham, LLP

(57) ABSTRACT

A method of removing a suspected section from a record includes obtaining an estimated distance between a communicating vehicle and a block boundary of a first block and a second block of a track. The suspected section is defined as a section of the first block between a communicating vehicle and a block boundary of the first block and the second block. An occupancy status of the second block is obtained. The suspected section is removed from the record after, for a predetermined time period, (a) the estimated distance remains less than a predetermined threshold distance and (b) the occupancy status of the second block remains a vacant state, the predetermined time period being a non-zero time period.

20 Claims, 7 Drawing Sheets

METHOD OF REMOVING SUSPECTED SECTION OF TRACK

BACKGROUND

A Communication Based Train Control (CBTC) system is usable to control the movement of one or more vehicles, such as one or more trains, within a railway network. The operation of the CBTC system relies upon communication between a server of the CBTC system and the trains. However, in practice, the communication between a train having corresponding communication equipment and the server of the CBTC system may be ineffective due to failures of the equipment. Also, sometimes an unequipped train may enter the railway network for maintenance or operational purposes. In order to manage the movement of vehicles in the railway network efficiently, the CBTC are designed to be able to not only identify a communicating vehicle (i.e., a communicating train, CT) but also the possible presence of a non-communicating vehicle (i.e., a non-communicating train, NCT).

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

Figure 1:
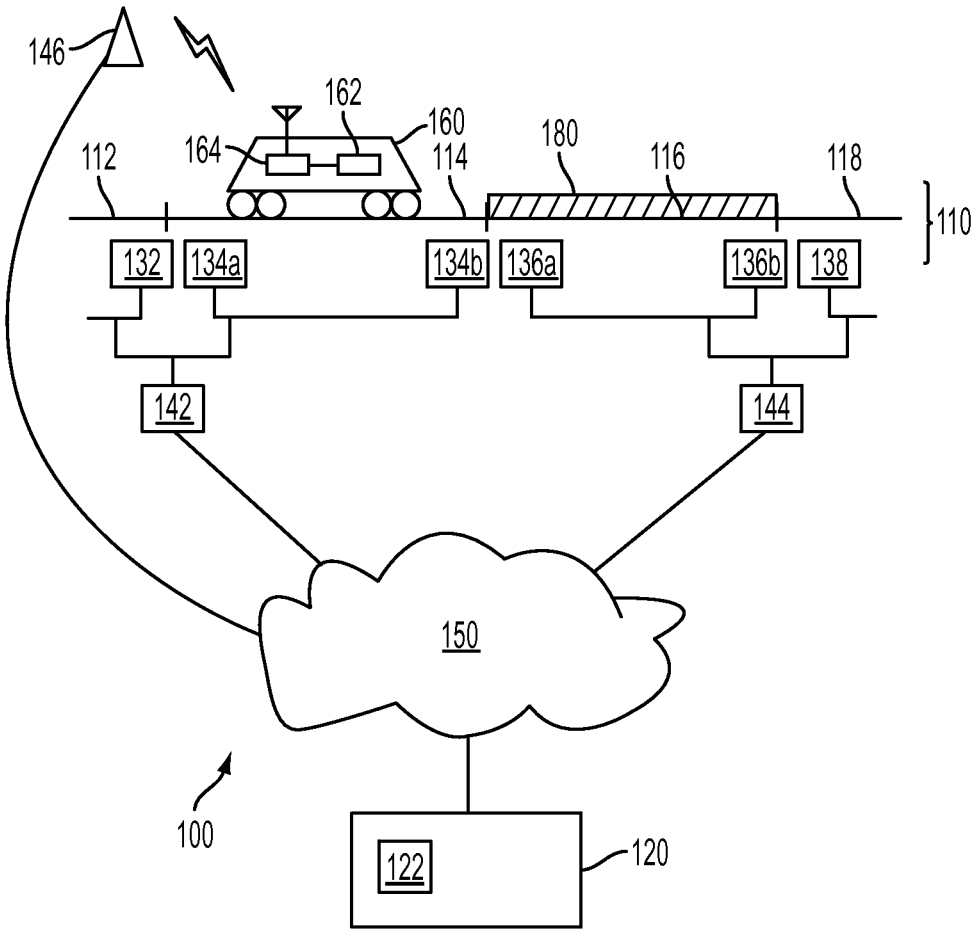
FIG. 1 is a system level diagram of a CBTC system in conjunction with a portion of a railway network in accordance with one or more embodiments.

It is understood that the following disclosure provides one or more different embodiments, or examples, for implementing different features of the disclosure. Specific examples of components and arrangements are described below to simplify the present disclosure. These are, of course, examples and are not intended to be limiting. In accordance with the standard practice in the industry, various features in the drawings are not drawn to scale and are used for illustration purposes only.

FIG. 1 is a system level diagram of a CBTC system 100 in conjunction with a portion of a railway network (represented by a portion of a railway track 110) in accordance with one or more embodiments. The railway track 110 is divided into a plurality of blocks 112, 114, 116, and 118. The CBTC system 100 includes central control equipment 120, a plurality of occupancy detection devices 132, 134*a*, 134*b*, 136*a*, 136*b*, and 138, a plurality of wayside devices 142, 144, and 146, and a network 150 connecting the central control equipment 120 and the wayside devices 142, 144, and 146. In some embodiments, network 150 is a wired network or a wireless network. The central control equipment 120 includes, among other things, a zone controller 122 configured to keep a record of one or more suspected sections that possibly have an NCT therein. Each of the suspected sections is all or a portion of a block 112, 114, 116, or 118.

Each of the blocks 112, 114, 116, and 118 has two boundaries defined by the corresponding occupancy detection devices 132, 134*a*, 134*b*, 136*a*, 136*b*, and 138. The occupancy detection devices 132, 134*a*, 134*b*, 136*a*, 136*b*, and 138 report detection signals to corresponding wayside devices 142 and 144. The wayside devices 142 and 144 then determine an occupancy status (either at a "vacant" state or an "occupied" state) of corresponding blocks 112, 114, 116, and 118 and report the occupancy status information to the central control equipment 120 via the network 150. In some embodiments, a pair of the occupancy detection devices 134*a*/134*b* or 136*a*/136*b* constitutes a set of Axle Counter Equipment (ACE) or a set of Track Circuits. In some embodiments, there is a latency period between a status-changing event and the receipt of the changed status by the zone controller 122. The latency period is caused by the processing time for detecting and processing the detected signals by the occupancy detection devices 132, 134*a*, 134*b*, 136*a*, 136*b*, and 138 and the wayside devices 142 and 144, the transmission delay in the network 150, and/or the processing time of the zone controller 122. Therefore, the occupancy status of the blocks as recognized by the zone controller 122 is not "synchronized" with the actual movement of the vehicles on the track 110.

A train 160 travels within the railway network (represented by the railway track 110). The train 160 includes on-board equipment 162 and a communication device 164. The on-board equipment 162 updates a position and a speed of the train 160, and the communication device 164 reports the latest position and speed of the train 160 to the central control equipment 120 via the wayside equipment 146 and the network 150. In some embodiments, there is a latency period between a position report and the current position/speed of the train. The latency period is caused by, for example, the processing time for the on-board equipment 162 and the communication delay among the communication device 164, the wayside equipment 146, and the network 150. Therefore, the reported position and speed of the train 160 is not "synchronized" with the actual position and speed of the train 160.

As depicted in FIG. 1, a suspected section 180 extends the entirety of a block 116. When there is a railway block 116 that is reported to be "occupied" by the corresponding occupancy detection devices (such as 136*a* and 136*b*), but the zone controller 122 does not have any information indicating any CT in the block 116, it is possible that an NCT is in that particular railway block 116. Thus, the entire block is marked as a suspected section 180 by the zone controller 122. In some embodiments, the zone controller 122 then relies upon a manually-operated CT (such as train 160) to run through the railway block 116 in order to confirm if there is an NCT in the suspected section 180. This operation is also known as Non Communicating Obstruction (NCO) removal.

In the example depicted in FIG. 1, block 114 has a status of "occupied" and is known to the zone controller 122 as being occupied by the CT 160. Also, the block 118 has a status of "vacant." In some embodiments, one or more blocks on the railway 110 have status of "occupied" without any communicating vehicle or non-communicating vehicle known to the zone controller 122, and thus are set to have one or more corresponding suspected sections. In some embodiments, a suspected section covers two or more railway blocks. In some embodiments, each of two or more blocks is marked as suspected sections.

In some embodiments, the record of one or more suspected sections stored in the zone controller 122 includes a list of suspected sections of the track 110 defined by a starting position and an ending position relative to a predetermined reference point of the track. In some embodiments, each of the blocks 112, 114, 116, and 118 are further divided into a plurality of micro-blocks, and the record of suspected sections is kept in a data field for marking or unmarking the micro-blocks as "suspected."

Figure 2:
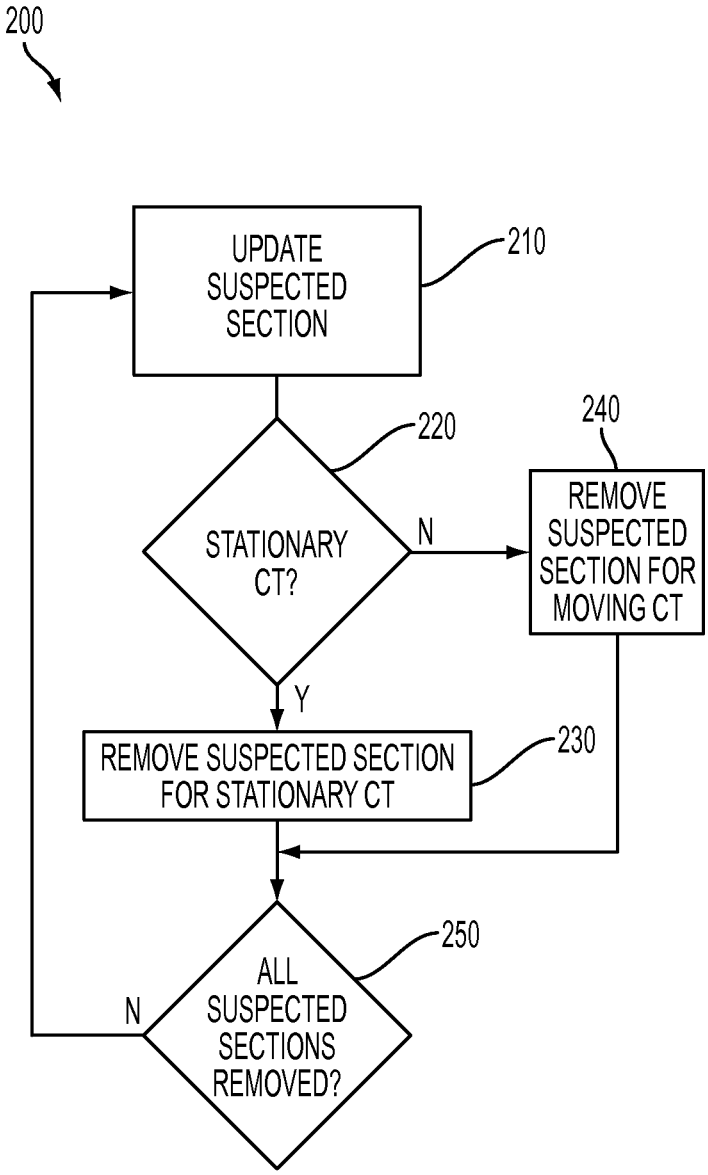
FIG. 2 is a flowchart of a method of removing a suspected section from a record in accordance with one or more embodiments.

FIG. 2 is a flowchart of a method 200 of removing a suspected section from a record stored by the zone controller 122 in accordance with one or more embodiments. It is understood that additional operations may be performed before, during, and/or after the method 200 depicted in FIG. 2, and that some other processes may only be briefly described herein.

As depicted in FIG. 2 and FIG. 1, in operation 210, as the CT 160 moves into the suspected section 180, any portion of the suspected section 180 successfully and unobstructively passed by the CT 160 is considered as "cleared" or "removed" by the zone controller 122. As such, the suspected section 180 is updated to exclude the portion by which the CT 160 successfully passed. In some embodiments, the update of a suspected section includes updating the start and/or end positions corresponding to the suspected section in the list of suspected sections. In some embodiments, the removal of a suspected section includes deleting the data corresponding to the suspected section in the list of suspected sections. In some embodiments, the update or removal of a suspected section includes unmarking the data fields of one or more micro-blocks corresponding to the suspected section.

In addition, in subsequent operations as detailed below, in order to expedite the NCO removal process, if the remaining portion of the suspected section 180 has a length less than a predetermined threshold distance, the remaining suspected section 220 is also "removed" by the zone controller 122. In some embodiments, the predetermined threshold distance corresponds to a minimum reference length of an NCT. The suspected section can be removed from the record by the zone controller 122 without actually passing through the suspected section because it is physically impossible to fit an NCT within the remaining suspected section. Meanwhile, by taking the message latency of the occupancy status of the railway blocks and asynchronicity of the train position and occupancy status of the railway blocks into consideration, the NCO removal methods as described in the present application are suitable for use without imposing speed limitations on the CT performing the NCO removal.

The process then proceeds to operation 220. Depending on the speed of the CT 160, different sets of operations are arranged for a stationary CT and a moving CT. In some embodiments, if the speed of the CT 160 is slow enough that the distance of travel of CT 160 during a maximum possible latency period is smaller than a predetermined threshold speed, the CT 160 is considered to be stationary. Thus, in operation 220, the zone controller 122 compares the speed of the CT 160 and a predetermined threshold speed. If the speed of the CT 160 is equal to or lower than the predetermined threshold speed, the process proceeds to the set of operations 230. Otherwise, the process proceeds to the set of operations 240. Details of sets of operations 230 and 240 are further described in conjunction with FIGS. 3 and 4.

After determining removal (without passing through) of the suspected section according to the sets of operations 230 or 240, the process then proceeds to operation 250, where the zone controller 122 confirms if all suspected sections of the track in the record are removed (deleted from the record or set to be unmarked). If one or more suspected sections of the track need to be further checked by the CT 210, the process returns to operation 310.

Figure 3:
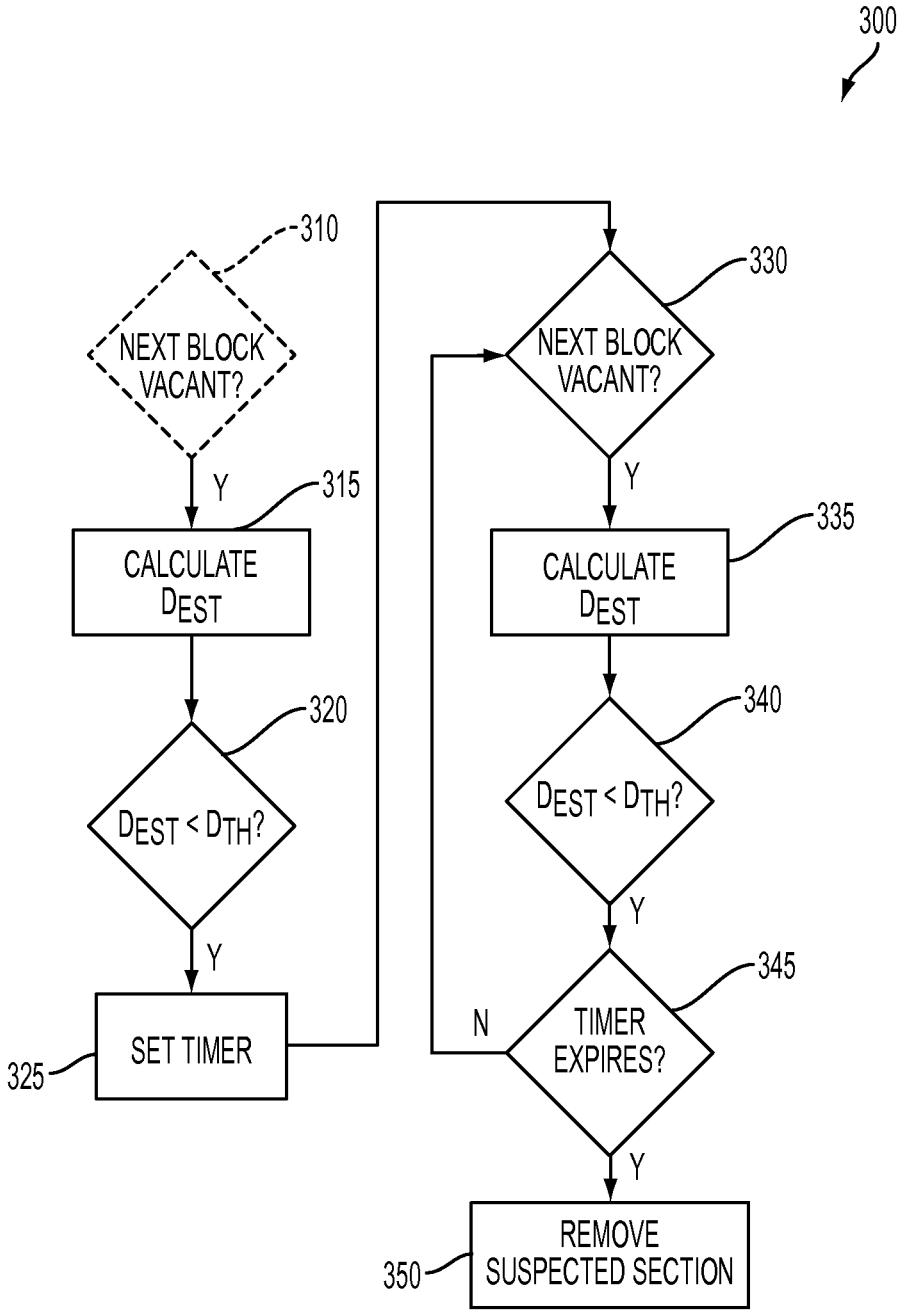
FIG. 3 is a flowchart of a portion of the method depicted in FIG. 2 in accordance with one or more embodiments.
Figure 4A:
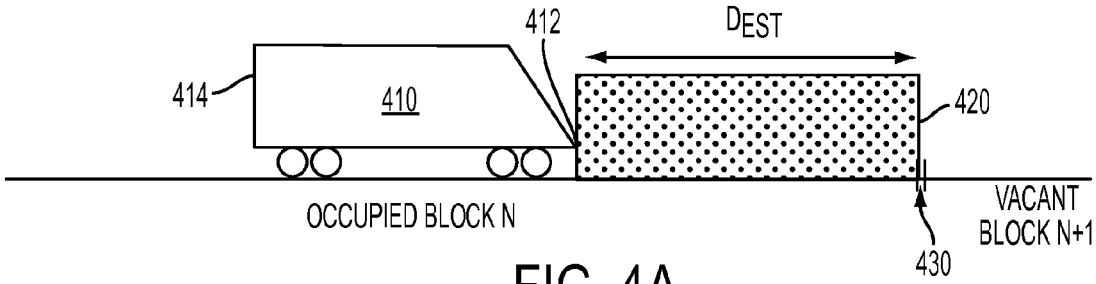
FIGS. 4A-4B are diagrams of various scenarios of removing a suspected section in conjunction with a stationary (or slow-moving) CT in accordance with one or more embodiments.
Figure 4B:
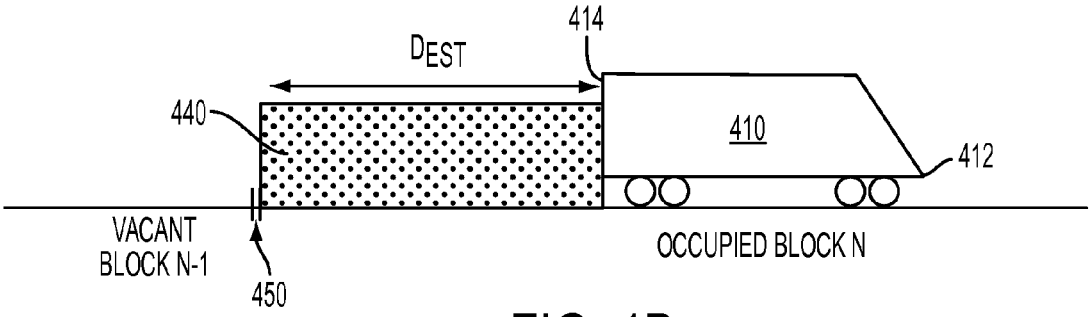

FIG. 3 is a flowchart of a method 300, which is a portion of the method 200 depicted in FIG. 2, in accordance with one or more embodiments. The method 300 depicted in FIG. 3 corresponds to the set of operations 230 in FIG. 2. FIGS. 4A-4B are diagrams of various scenarios of removing a suspected section in conjunction with a stationary (or slow-moving) CT 410 in accordance with one or more embodiments. It is understood that additional operations may be performed before, during, and/or after the method 300 depicted in FIG. 3, and that some other processes may only be briefly described herein.

As depicted in FIG. 3 and FIG. 4A, the CT 410 enters block N to check if there is an NCT in the suspected section 420. The next neighboring block N+1 has a "vacant" status, and thus the NCO removal process of the suspected section 420 is deemed completed after the suspected section 420 is removed from the record of the zone controller 122. Prior to the CT 410 actually passing through the entire suspected section 420, the remaining suspected region 420 of block N, between the CT 410 and the block boundary 430 of block N and block N+1, is considered to be removable if an estimated length of the suspected section 420 is less than a predetermined threshold distance that any NCT present in the railway system cannot physically fit into the suspected section 420. However, the zone controller 122 is also configured to rule out the possibility that a portion of an NCT in the suspected section 420 may have entered the next block N+1 prior to the change of the occupancy status of block N+1 received by the zone controller 122.

In optional operation 310, the zone controller 122 checks the occupancy status of block N+1. If the occupancy status of block N+1 is not at the "vacant" state, the process is terminated because the zone controller 122 cannot remove the suspected section 420 without letting the CT 410 passing through the suspected section 420. If it is confirmed that the occupancy status of block N+1 is "vacant," the process proceeds to operation 315.

In operation 415, an estimated distance $D_{EST}$ between the CT 410 and the block boundary 430, which corresponds to an estimated length of the suspected section 420, is calculated. In some embodiments, the calculation of the estimated distance $D_{EST}$ is performed based on a position report from the CT 410. As depicted in FIG. 4A, the CT 410 includes a front end 412 and a rear end 414, and the front end 412 is closer to the block boundary 430 than the rear end 414. The calculation of the estimated distance $D_{EST}$ includes obtaining a reference position of the first end 412 according to the position report from the CT 410. The estimated distance $D_{EST}$ thus is calculated according to the reference position of the front end 412 and a position of the block boundary 430 on the track. In some embodiments, the position of the block boundary 430 is known to the zone controller 122 because the positions of the occupancy detection devices 132, 134*a*, 134*b*, 136*a*, 136*b*, and 138 are known and pre-stored in a storage device accessible to the zone controller 122.

In some embodiments, the CT 410 provides the zone controller position reports periodically according to a predetermined refresh duration. In some embodiments, the calculation of the estimated distance $D_{EST}$ is based upon the latest position report accessible to the zone controller 122.

In some embodiments, tolerance of uncertainty with regard to the train position or the boundary position is also taken into account in calculating the estimated distance $D_{EST}$. In some embodiments, a nominal distance between the reference position of the front end 412 and the position of the block boundary 430 is calculated without considering the effect of uncertainty. Then, the estimated distance $D_{EST}$ is obtained by adding a predetermined adjustment value and the nominal distance. In some embodiments, the predetermined adjustment value is a summation of one or more of a predetermined overhang of the CT 410, a predetermined overhang of a possible NCT in the present railway system, a predetermined tolerance of the reported position of the first end 412, or a predetermined tolerance of the position of the block boundary 430, and similar suitable parameters.

After obtaining the estimated distance $D_{EST}$, the process proceeds to operation 320 where the zone controller 122 determines if the estimated distance $D_{EST}$ is less than a predetermined threshold distance $D_{TH}$. In some embodiments, the predetermined threshold distance $D_{TH}$ corresponds to a minimum length of NCTs present in the railway system. If the estimated distance $D_{EST}$ is not less than the predetermined threshold distance $D_{TH}$, the process is terminated because it is possible that an NCT could be in the suspected section, and thus the zone controller 122 cannot remove the suspected section 420. If the estimated distance $D_{EST}$ is less than the predetermined threshold distance $D_{TH}$, the process proceeds to operation 325 where the zone controller 122 sets a timer which is configured to expire after a predetermined time period.

The predetermined time period is a non-zero time period used to model the latency period of the change of the occupancy-status. In some embodiments, the predetermined time period is set based upon a processing time between occurrence of an occupancy status-changing event in the block N+1 and the receipt of the occupancy status-changing event by the zone controller 122.

After the timer is set, the zone controller 122 removes the suspected section 420 from the record after, for the predetermined time period, the estimated distance $D_{EST}$ remains to be less than the predetermined threshold distance $D_{TH}$ and the occupancy status of the block N+1 remains at the "vacant" state. As depicted in FIG. 3, in operations 330, 335, and 340, the zone controller 122 checks if the block N remains at the "vacant" state, calculates the estimated distance $D_{EST}$, and determines if the estimated distance $D_{EST}$ is less than the predetermined threshold distance $D_{TH}$, as similarly performed in operations 310, 315, and 320. In operation 345, the zone controller 122 determines if the timer has expired. The process loops back to operation 330 if the timer has not yet expired. Otherwise, in operation 450, after the timer expires, the zone controller 122 removes the suspected section 420.

In some embodiments, operation 335 is repetitively performed before the timer expires based upon one or more of a plurality of position reports from the CT 410. In some embodiments, the estimated distance $D_{EST}$ is calculated based upon the latest position report accessible to the zone controller 122 every time operation 345 loops back to operation 330.

FIG. 4B is a diagram of the CT 410 for removing the suspected section 440 behind the CT 410, between the CT 410 and a block boundary 450 of the block N and block N−1. Similar to the CT 410 in FIG. 4A, the CT 410 in FIG. 4B includes a front end 412 and a rear end 414, and the rear end 414 is closer to the block boundary 450 than the front end 412. The estimated distance $D_{EST}$ in FIG. 4B is now calculated based on the reference position of the rear end 414, and the next block at issue is now block N−1 instead of block N+1. Otherwise, the process to remove the suspected section 440 from the record of the zone controller 122 is basically similar to the process described above in conjunction with FIGS. 3 and 4A.

Figure 5:
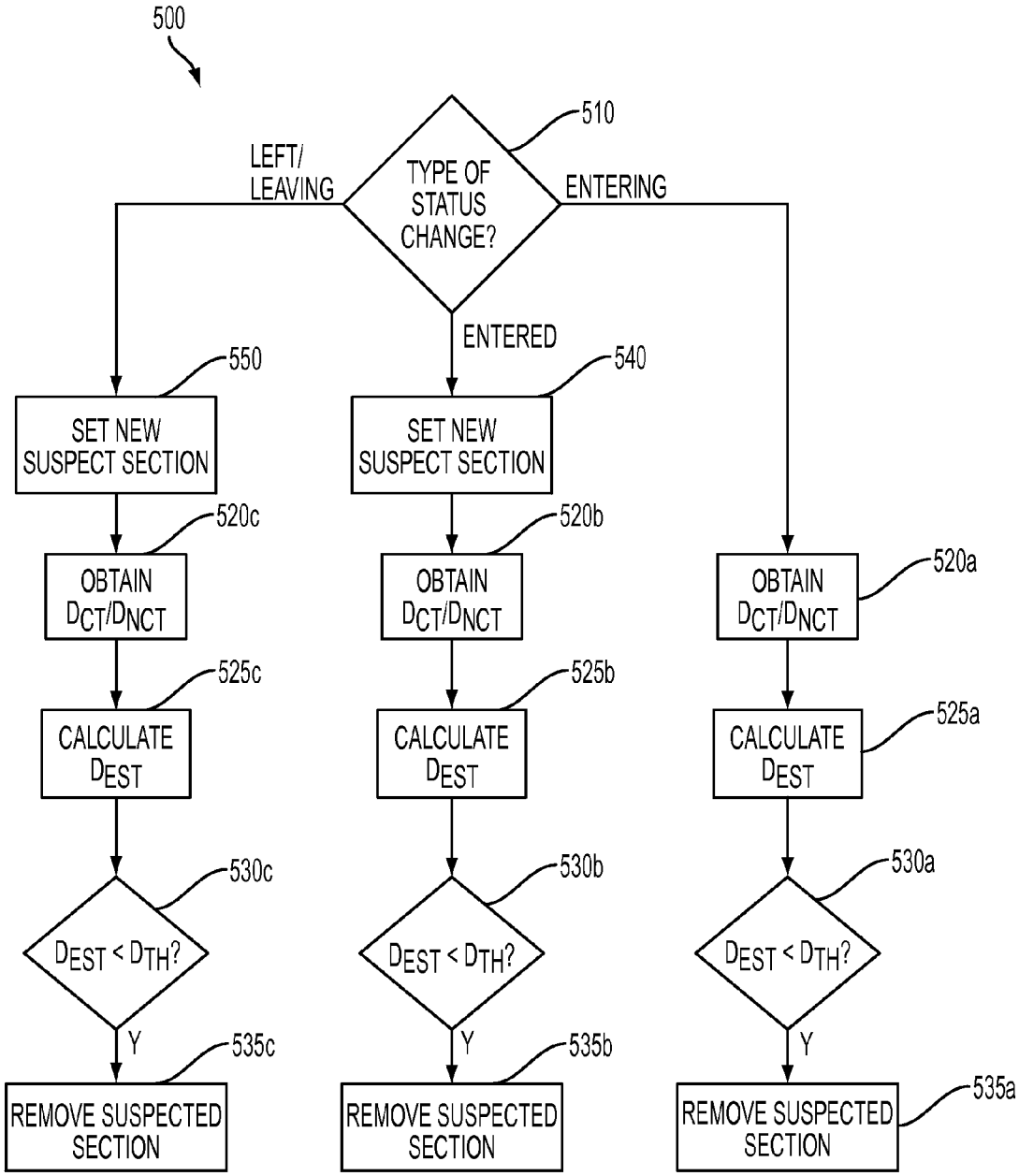
FIG. 5 is a flowchart of another portion of the method depicted in FIG. 2 in accordance with one or more embodiments.
Figure 6A:
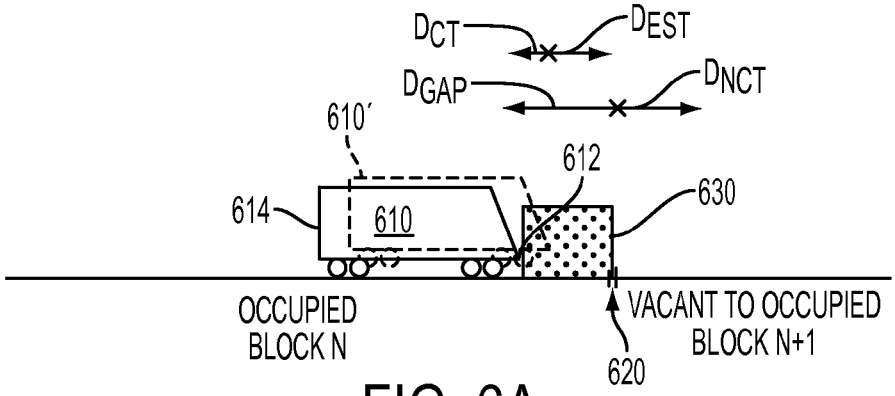
FIGS. 6A-6C are diagrams of various scenarios of removing a suspected section in conjunction with a moving CT in accordance with one or more embodiments.
Figure 6B:
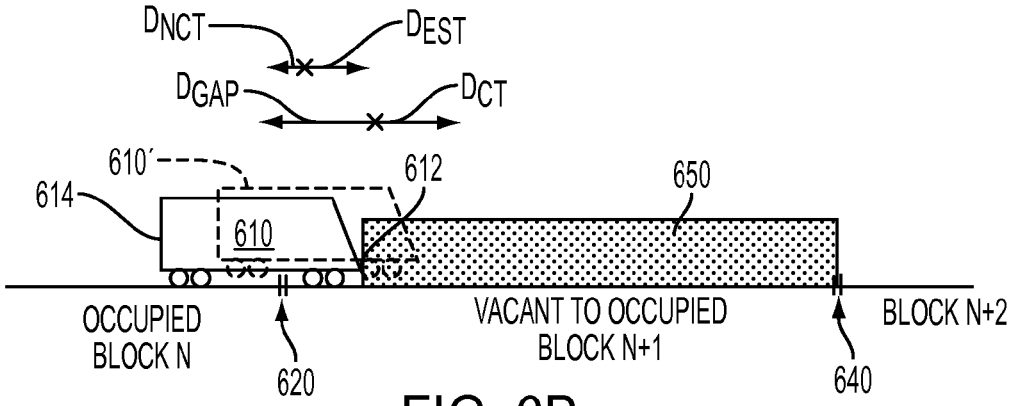
Figure 6C:
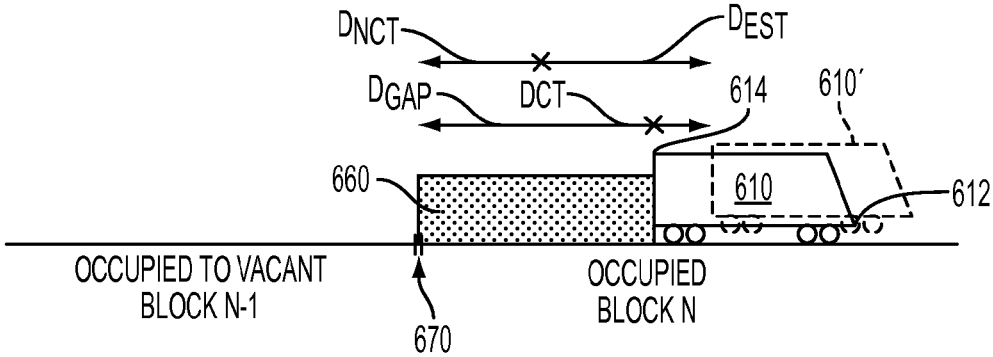

FIG. 5 is a flowchart of a method 500, which is a portion of the method 200 depicted in FIG. 2, in accordance with one or more embodiments. The method 500 depicted in FIG. 5 correspond to the set of operations 240 in FIG. 2. FIGS. 6A-6C are diagrams of various scenarios of removing a suspected section in conjunction with a moving CT 610 in accordance with one or more embodiments. It is understood that additional operations may be performed before, during, and/or after the method 600 depicted in FIG. 6, and that some other processes may only be briefly described herein.

As depicted in FIGS. 6A-6B, when the CT 610 moves from block N to block N+1, the occupancy status of block N+1 is changed from "vacant" to "occupied." The zone controller 122, upon the receipt of the change of occupancy status of the block N+1, is configured to determine if the change of occupancy status of block N+1 is caused by a moving NCT in front of the CT 610 or by a front end 612 of the CT 610. As depicted in FIG. 6C, when the CT 610 moves from block N−1 to block N, the occupancy status of block N−1 is changed from "occupied" to "vacant." The zone controller 122, upon the receipt of the change of occupancy status of the block N−1, is configured to determine if the change of occupancy status of the block N−1 is caused by a moving NCT following the CT 610 or by a rear end 614 of the CT 610.

As depicted in FIG. 5 and FIGS. 6A-6C, the method 500 begins with operation 510, where the zone controller 122 determines if the CT 610 left (or is leaving), is entering, or entered the block corresponding to the change of occupancy status just received by the zone controller 122. If the latest reported position of the front end 612 of the CT 610 is still in block N when the change of occupancy status of block N+1 is received by the zone controller 122, the process proceeds to operation 520*a*. Taking the latency of the position report of the CT 610 into consideration, the CT 610 may have moved forward (as represented by the dotted CT 610'). Also, a hypothetical NCT is adapted to model the occurrence of an occupancy status-changing event in the block N+1. Taking the latency of the change of occupancy status in the present railway system into consideration, the hypothetical NCT may have moved forward during the corresponding latency period as well.

As depicted in FIG. 5 and FIG. 6A, in operation 520*a*, the zone controller 122 obtains a reference travel distance $D_{NCT}$ of the hypothetical NCT (from a block boundary 620 between block N and block N+1) during a predetermined time period in response to the change of occupancy status of block N+1. In some embodiments, the predetermined time period is set based upon a processing time between occurrence of an occupancy status-changing event in the block N+1 and the receipt of the occupancy status-changing event by the zone controller 122. In addition, the zone controller 122 also obtains a reference travel distance $D_{CT}$ (the front end 612 of the CT 610) of the CT 610' during a predetermined refresh duration of position reports of the CT 610. In some embodiments, the CT 610 provides the zone controller 122 position reports periodically according to the predetermined refresh duration. In some embodiments, the predetermined refresh duration ranges from 150 ms to 1 s. As depicted in FIG. 6A, a suspected section 630 is still in the record of the zone controller 122 because the CT 610 has not passed through the suspected section 630 at the time the zone controller receives the report of status change of the block N+1.

In some embodiments, the reference travel distance $D_{NCT}$ of the hypothetical NCT is the maximum possible travel distance of the hypothetical NCT during the predetermined time period. In some embodiments, the reference travel distance $D_{CT}$ of the CT 610 is the minimum possible travel distance of the CT 610 during the predetermined refresh duration ($T_R$). An example equation for the calculation is:

$$D_{CT}=T_R*V_{CT}$$

In some embodiments, the calculation of the reference travel distance $D_{NCT}$ of the hypothetical NCT includes obtaining the latest reported speed $V_{CT}$ of the CT 610 and multiplying the reported speed $V_{CT}$ by the predetermined time period ($T_{LATENCY}$). In some embodiments, the calculation of the reference travel distance $D_{CT}$ of the CT 610 includes obtaining the latest reported speed $V_{CT}$ and a reported position of the front end 612 of the CT 610 and multiplying the reported speed $V_{CT}$ by the predetermined refresh duration. An example equation for the calculation is:

$$D_{NCT}=T_{LATENCY}*V_{CT}$$

The process then proceeds to operation 525*a*, where the zone controller 122 calculates an estimated distance $D_{EST}$ between the CT 610' (with inclusion of the reference travel distance $D_{CT}$ of the CT 610) and the hypothetical NCT. In some embodiments, the calculation of the estimated distance includes obtaining a reference distance $D_{GAP}$ between the reference position of the front end 612 and the block boundary 620 according to a position report from the CT 610. The estimated distance $D_{EST}$ is then calculated by adding the reference travel distance $D_{NCT}$ of the hypothetical NCT to, and subtracting the reference travel distance $D_{CT}$ of the CT 610 from, the reference distance $D_{GAP}$. An example equation for the calculation is:

$$D_{EST}=D_{GAP}+D_{NCT}-D_{CT}$$

In some embodiments, a position uncertainty tolerance with regard to the train position or the boundary position is also taken into account when calculating the reference distance $D_{GAP}$. In some embodiments, a nominal distance between the reference position of the front end 612 and the position of the block boundary 620 is calculated without considering the uncertainty. The reference distance $D_{GAP}$ is then obtained by adding a predetermined adjustment value and the nominal distance. In some embodiments, the predetermined adjustment value is a summation of one or more of a predetermined overhang of the CT 610, a predetermined overhang of a possible NCT in the present railway system, a predetermined tolerance of the reported position of the front end 612, and a predetermined tolerance of the position of the block boundary 620, and other suitable parameters.

After obtaining the estimated distance $D_{EST}$, the process proceeds to operation 530*a*, where the zone controller 122 determines if the estimated distance $D_{EST}$ is less than a predetermined threshold distance $D_{TH}$. In some embodiments, the predetermined threshold distance $D_{TH}$ corresponds to a minimum length of NCTs in the present railway system. If the estimated distance $D_{EST}$ is not less than the predetermined threshold distance $D_{TH}$, the process is terminated because the zone controller 122 cannot remove the suspected section 630 yet. If the estimated distance $D_{EST}$ is less than the predetermined threshold distance $D_{TH}$, the process proceeds to operation 535, where the zone controller 122 removes the suspected section 630.

As depicted in FIG. 5 and FIG. 6B, in operation 510, if the latest reported position of the front end 612 of the CT 610 is already in block N+1 when the change of occupancy status of block N+1 is received by the zone controller 122, the process proceeds to operation 540. Block N+1 has a first block boundary 620 between block N and block N+1 and a second block boundary 640 between block N+1 and block N+2. The CT 610 is moving along a direction from the first boundary 620 toward the second boundary 640. In operation 540, a new suspected section 650 between the CT 610 and the second block boundary 640 is created in the record of the zone controller 122 out of the concern of having an unidentified NCT moving in front of the CT 610.

The process then proceeds to operation 520*b*, the zone controller 122 obtains a reference travel distance $D_{NCT}$ of the hypothetical NCT during the predetermined time period, from the block boundary 620 between block N and block N+1, in response to the change of occupancy status of block N+1. In addition, the zone controller 122 also obtains a reference travel distance $D_{CT}$ of the CT 610 during the predetermined refresh duration, from a reference position of the front end 612 of the CT 610, in response to the change of occupancy status of block N+1.

In some embodiments, the reference travel distance $D_{NCT}$ of the hypothetical NCT is the minimum possible travel distance of the hypothetical NCT during the predetermined time period. In some embodiments, the reference travel distance $D_{CT}$ of the CT 610 is the maximum possible travel distance of the CT 610 during the predetermined refresh duration.

In some embodiments, the reference travel distances $D_{CT}$ and $D_{NCT}$ are determined in a manner similar to that described above for operation 520*a*, and thus the details of the calculation of the reference travel distances $D_{CT}$ and $D_{NCT}$ are not repeated.

The process then proceeds to operation 525*b*, where the zone controller 122 calculates an estimated distance $D_{EST}$ between the CT 610' and the hypothetical NCT. An example equation for the calculation is:

$$D_{EST}=D_{GAP}+D_{CT}-D_{NCT}$$

In some embodiments, the calculation of the estimated distance includes obtaining a reference distance $D_{GAP}$ between the reference position of the front end 612 and the block boundary 620 according to a position report from the CT 610. The estimated distance $D_{EST}$ is then calculated by subtracting the reference travel distance $D_{NCT}$ of the hypothetical NCT from, and adding the reference travel distance $D_{CT}$ of the CT 610 to, the reference distance $D_{GAP}$. In some embodiments, the uncertainty tolerance with regard to the train position or the boundary position is also taken into account when calculating the reference distance $D_{GAP}$, as similarly described above with regard to operation 525*a*.

After obtaining the estimated distance $D_{EST}$, the process proceeds to operation 530*b*, where the zone controller 122 determines if the estimated distance $D_{EST}$ is less than the predetermined threshold distance $D_{TH}$. If the estimated distance $D_{EST}$ is not less than the predetermined threshold distance $D_{TH}$, the process is terminated because the zone controller 122 cannot remove the suspected section 650 yet. If the estimated distance $D_{EST}$ is less than the predetermined threshold distance $D_{TH}$, the process proceeds to operation 535*b*, where the zone controller 122 removes the suspected section 650.

As depicted in FIG. 5 and FIG. 6C, in operation 510, if the latest reported position of the rear end 614 of the CT 610 is in block N when the change of occupancy status of block N−1 from occupied to vacant is received by the zone controller 122, the process moves on to operation 550, where a new suspected section 660 between the CT 610 and a block boundary 670 of block N−1 and block N is created in the record of the zone controller 122 because of the concern of having an unidentified NCT following the rear end 614 of the CT 610.

The process then moves on to operation 520*c*, where the zone controller 122 obtains a reference travel distance $D_{NCT}$ of the hypothetical NCT during the predetermined time period, from the block boundary 670 between block N−1 and block N, in response to the change of occupancy status of block N−1. In addition, the zone controller 122 also obtains a reference travel distance $D_{CT}$ of the CT 610 during the predetermined refresh duration, from a reference position of the front end 612 of the CT 610, in response to the change of occupancy status of block N−1.

In some embodiments, the reference travel distance $D_{NCT}$ of the hypothetical NCT is the minimum possible travel distance of the hypothetical NCT during the predetermined time period. In some embodiments, the reference travel distance $D_{CT}$ of the CT 610 is the maximum possible travel distance of the CT 610 during the predetermined refresh duration. In some embodiments, the reference travel distances $D_{CT}$ and $D_{NCT}$ are determined in a manner similar to that described above for operation 520*a*, and thus the details of the calculation of the reference travel distances $D_{CT}$ and $D_{NCT}$ are not repeated.

The process then proceeds to operation 525*c*, where the zone controller 122 calculates an estimated distance $D_{EST}$ between the CT 610' and the hypothetical NCT. An example equation for the calculation is:

$$D_{EST}=D_{GAP}+D_{CT}-D_{NCT}$$

In some embodiments, the calculation of the estimated distance includes obtaining a reference distance $D_{GAP}$ between the reference position of the rear end 614 and the block boundary 670 according to a position report from the CT 610. The estimated distance $D_{EST}$ is then calculated by subtracting the reference travel distance $D_{NCT}$ of the hypothetical NCT from, and adding the reference travel distance $D_{CT}$ of the CT 610 to, the reference distance $D_{GAP}$. In some embodiments, the uncertainty tolerance with regard to the train position or the boundary position is also taken into account when calculating the reference distance $D_{GAP}$, as similarly described above with regard to operation 525*a*.

After obtaining the estimated distance $D_{EST}$, the process proceeds to operation 530*c*, where the zone controller 122 determines if the estimated distance $D_{EST}$ is less than the predetermined threshold distance $D_{TH}$. If the estimated distance $D_{EST}$ is not less than the predetermined threshold distance $D_{TH}$, the process is terminated because the zone controller 122 cannot remove the suspected section 660 yet. If the estimated distance $D_{EST}$ is less than the predetermined threshold distance $D_{TH}$, the process proceeds to operation 535*c*, where the zone controller 122 removes the suspected section 670.

Figure 7:
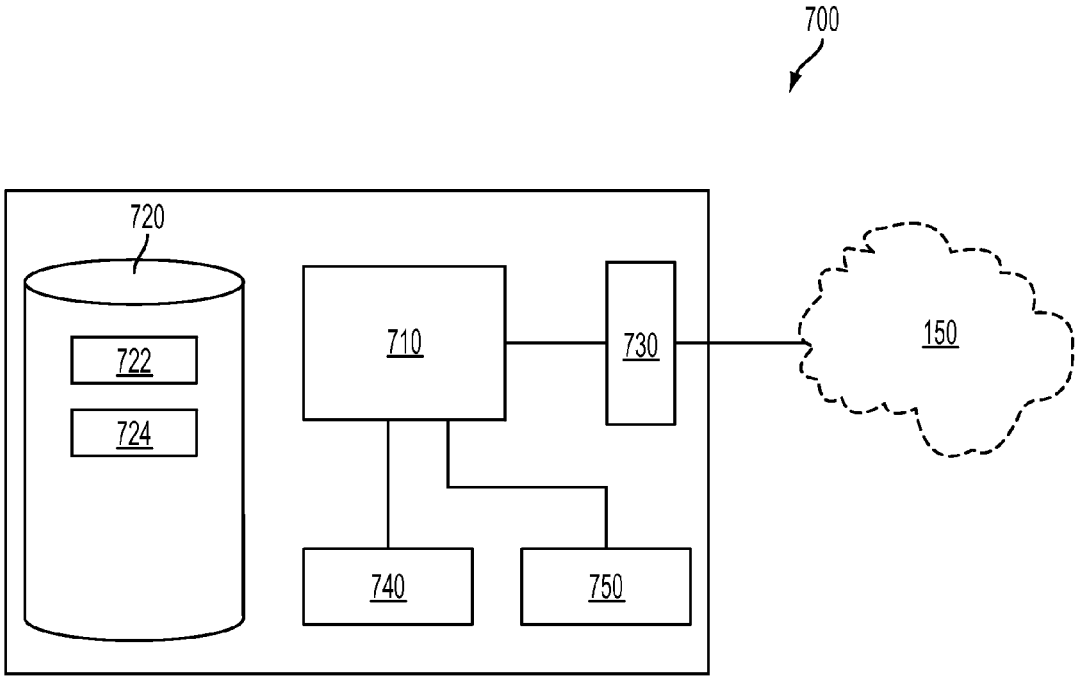
FIG. 7 is a block diagram of a zone controller in accordance with one or more embodiments.

FIG. 7 is a block diagram of a zone controller 700 usable as the zone controller in FIG. 1 in accordance with one or more embodiments. The zone controller 700 is usable to perform the method as depicted in FIGS. 2, 3, and 5.

The zone controller 700 includes the hardware processor 710 and a non-transitory, computer readable storage medium 720 encoded with, i.e., storing, the computer program code 722, i.e., a set of executable instructions. The processor 710 is electrically coupled to the computer readable storage medium 720. The processor 710 is configured to execute the computer program code 722 encoded in the computer readable storage medium 720 in order to cause the zone controller 700 to perform a portion or all of the operations as depicted in FIGS. 2, 3, and 5.

The zone controller 700 also includes a network interface 730, a display 740, and an input device 750 coupled to the processor 710. The network interface 730 allows the zone controller 700 to communicate with the network 150 (FIG. 1). The network interface 730 includes wireless network interfaces such as BLUETOOTH, WIFI, WIMAX, GPRS, or WCDMA; or wired network interface such as ETHERNET, USB, or IEEE-1394. The display 740 is usable to graphically indicate the performance of the method as depicted in FIGS. 2, 3, and 5. The input device 750 allows an operator of the zone controller 700 to input any information that is usable for the performance of the method as depicted in FIGS. 2, 3, and 5. Also, the display 740 and the input device 750 together allow the operator of the zone controller 700 to control the zone controller 700 in an interactive manner. In some embodiments, display 740 and input device 750 are not present.

In some embodiments, the processor 710 is a central processing unit (CPU), a multi-processor, a distributed processing system, an application specific integrated circuit (ASIC), and/or a suitable processing unit.

In some embodiments, the computer readable storage medium 720 is an electronic, magnetic, optical, electromagnetic, infrared, and/or a semiconductor system (or apparatus or device). For example, the computer readable storage medium 720 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 720 includes a compact disk-read only memory (CD-ROM), a compact disk-read/write (CD-R/W), and/or a digital video disc (DVD).

In some embodiments, the storage medium 720 stores the computer program code 722 configured to cause the zone controller 700 to perform the method as depicted in FIGS. 2, 3, and 5. In some embodiments, the storage medium 720 also stores information or data 724 needed for performing the methods 200, 300, and 500 or generated during performing the methods 200, 300, and 500, such as the position of the occupancy detection devices, the latest position of trains, the latest speed of trains, occupancy status of blocks, records of suspected sections, and etc.

In accordance with one embodiment, a method of removing a suspected section from a record includes determining an estimated distance between a communicating vehicle and a block boundary of a first block and a second block of a track. The suspected section is defined as a section of the first block between a communicating vehicle and a block boundary of the first block and the second block. An occupancy status of the second block is determined. The suspected section is removed from the record after, for a predetermined time period, (a) the estimated distance remains less than a predetermined threshold distance and (b) the occupancy status of the second block remains a vacant state, the predetermined time period being a non-zero time period.

In accordance with another embodiment, a method of removing a suspected section from a record is disclosed, where the suspected section is defined as a section of a first block of a track between a communicating vehicle and a block boundary of the first block and a second block of the track. The method includes determining a change of occupancy status of the second block. A reference travel distance of a hypothetical vehicle is determined in response to the change of occupancy status of the second block. The hypothetical vehicle is adapted to model occurrence of an occupancy status-changing event in the second block. An estimated distance between the communicating vehicle and the hypothetical vehicle is calculated. The suspected section is removed from the record if the estimated distance is less than a predetermined threshold distance.

In accordance with another embodiment, a method of removing a suspected section of a first block of a track from a record includes determining change of occupancy status of the first block from a vacant state to an occupied state. The first block has a first block boundary and a second block boundary, and a communicating vehicle moving along a direction from the first block boundary to the second block boundary. The suspected section is defined as a section of the first block between the communicating vehicle and the second block boundary. A reference travel distance of a hypothetical vehicle is determined in response to the change of occupancy status of the first block. The hypothetical vehicle is adapted to model occurrence of an occupancy status-changing event in the first block. An estimated distance between the communicating vehicle and the position of the hypothetical vehicle is calculated. The suspected section is removed from the record if the estimated distance is less than a predetermined threshold distance.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method of removing a suspected section of track from a record, the suspected section being defined as a section of a first block of a track between a communicating vehicle and a block boundary of the first block and a second block of the track, the method comprising:

determining, by a hardware processor, an estimated distance between the communicating vehicle and the block boundary;

determining, by the processor, an occupancy status of the second block; and removing the suspected section from the record after, for a predetermined time period, (a) the estimated distance remains less than a predetermined threshold distance and (b) the occupancy status of the second block remains a vacant state, the predetermined time period being a non-zero time period.

2. The method of claim 1, wherein the predetermined time period being set based upon a processing time between occurrence of an occupancy status-changing event in the second block and the receipt of the occupancy status-changing event by the processor.

3. The method of claim 1, further comprising:

activating a timer after (a) the estimated distance becomes less than the predetermined threshold distance and (b) the occupancy status of the second block is the vacant state, the timer being set to expire after the predetermined time period, wherein the removing the suspected section is performed after the expiry of the timer.

4. The method of claim 1, wherein the communicating vehicle comprising a first end and a second end, the first end is closer to the block boundary than the second end, and the determining the estimated distance comprises:

calculating the estimated distance according to a reference position of the first end according to a position report from the communicating vehicle and a position of the block boundary.

5. The method of claim 4, wherein the calculating the estimated distance comprises:

calculating a nominal distance between the reference position of the first end and the position of the block boundary; and adding a predetermined adjustment value to the nominal distance as the estimated distance.

6. The method of claim 5, wherein the predetermined adjustment value is a summation of one or more of a predetermined overhang of the communicating vehicle, a predetermined overhang of the non-communicating vehicle, a predetermined tolerance of the reported position of the first end, and a predetermined tolerance of the position of the block boundary.

7. The method of claim 1, wherein the determining the estimated distance is repetitively performed based on one or more of a plurality of position reports from the communicating vehicle.

8. A method of removing a suspected section from a record, the suspected section being defined as a section of a first block of a track between a communicating vehicle and a block boundary of the first block and a second block of the track, the method comprising:

determining, by a hardware processor, a change of occupancy status of the second block;

determining a reference travel distance of a hypothetical vehicle in response to the change of occupancy status of the second block, the hypothetical vehicle being adapted to model occurrence of an occupancy status-changing event in the second block;

calculating an estimated distance between the communicating vehicle and the hypothetical vehicle; and removing the suspected section from the record if the estimated distance is less than a predetermined threshold distance.

9. The method of claim 8, further comprising:

calculating the reference travel distance of the hypothetical vehicle according to a reported speed of the communicating vehicle.

10. The method of claim 9, wherein the calculating the reference travel distance of the hypothetical vehicle comprises multiplying the reported speed by a predetermined time period, wherein the predetermined time period is set based upon a processing time between occurrence of an occupancy status-changing event in the second block and the receipt of the occupancy status-changing event by the processor.

11. The method of claim 8, wherein the communicating vehicle comprises a first end and a second end, the first end is closer to the block boundary than the second end, and the calculating the estimated distance comprises:

determining a reported speed of the communicating vehicle;

determining a reference position of the first end and a reference distance between the reference position and the block boundary according to a position report from the communicating vehicle;

calculating a reference travel distance of the communicating vehicle according to the reported speed and a predetermined refresh duration corresponding to the position report;

calculating the estimated distance according to the reference distance between the reference position and the block boundary, the reference travel distance of the communicating vehicle, and the reference travel distance of the hypothetical vehicle.

12. The method of claim 11, wherein the first end is moving toward the block boundary, the change of occupancy status of the second block is from a vacant state to an occupied state, and the calculating the estimated distance comprises (a) adding the reference travel distance of the hypothetical vehicle to the reference distance between the reference position and the block boundary and (b) subtracting the reference travel distance of the communicating vehicle from the reference distance between the reference position and the block boundary.

13. The method of claim 11, wherein the first end is moving away from the block boundary, the change of occupancy status of the second block is from an occupied state to a vacant state, and the calculating the estimated distance comprises (a) subtracting the reference travel distance of the hypothetical vehicle from the reference distance between the reference position and the block boundary and (b) adding the reference travel distance of the communicating vehicle to the reference distance between the reference position and the block boundary.

14. The method of claim 11, wherein the determining the reference distance comprises:

calculating a nominal distance between the reference position of the first end and the position of the block boundary; and subtracting a predetermined adjustment value from the nominal distance as the reference distance.

15. The method of claim 14, wherein the predetermined adjustment value is a summation of one or more of a predetermined overhang of the communicating vehicle, a predetermined overhang of the non-communicating vehicle, a predetermined tolerance of the reported position of the first end, and a predetermined tolerance of the position of the block boundary.

16. A method of removing a suspected section of a first block of a track from a record, comprising:

determining, by a hardware processor, change of occupancy status of the first block from a vacant state to an occupied state, the first block comprising a first block boundary and a second block boundary, a communicating vehicle moving along a direction from the first block boundary to the second block boundary, and the suspected section being defined as a section of the first block between the communicating vehicle and the second block boundary;

determining a reference travel distance of a hypothetical vehicle in response to the change of occupancy status of the first block, the hypothetical vehicle being adapted to model occurrence of an occupancy status-changing event in the first block;

calculating an estimated distance between the communicating vehicle and the position of the hypothetical vehicle; and removing the suspected section from the record if the estimated distance is less than a predetermined threshold distance.

17. The method of claim 16, further comprising:

calculating the reference travel distance of the hypothetical vehicle according to a reported speed of the communicating vehicle.

18. The method of claim 17, wherein the calculating the reference travel distance of the hypothetical vehicle comprises multiplying the reported speed by a predetermined time period, wherein the predetermined time period is set based upon a processing time between occurrence of an occupancy status-changing event in the second block and the receipt of the occupancy status-changing event by the processor.

19. The method of claim 16, wherein the communicating vehicle comprises a first end and a second end, the first end is closer to the second block boundary than the second end, and the calculating the estimated distance comprises:

determining a reported speed of the communicating vehicle;

determining a reference position of the first end and a reference distance between the reference position and the first block boundary according to a position report from the communicating vehicle;

calculating a reference travel distance of the communicating vehicle according to the reported speed and a predetermined refresh duration corresponding to the position report;

calculating the estimated distance according to the reference distance between the reference position and the first block boundary, the reference travel distance of the communicating vehicle, and the reference travel distance of the hypothetical vehicle.

20. The method of claim 19, wherein the calculating the estimated distance comprises (a) subtracting the reference travel distance of the hypothetical vehicle from the reference distance between the reference position and the block boundary and (b) adding the reference travel distance of the communicating vehicle to the reference distance between the reference position and the block boundary.

* * * * *